United States Patent [19]

Reeves, Jr. et al.

[11] Patent Number: 4,703,780

[45] Date of Patent: Nov. 3, 1987

[54] DRUM FILLING APPARATUS AND METHOD

[75] Inventors: Robert H. Reeves, Jr.; Donald H. Green; Jimmy A. Birdwell; Henry A. Jorgensen, all of Freeport, Tex.

[73] Assignee: Velasco Scale Company, Freeport, Tex.

[21] Appl. No.: 921,956

[22] Filed: Oct. 20, 1986

[51] Int. Cl.[4] ..... B65B 3/28

[52] U.S. Cl. ..... 141/1; 141/83; 141/128; 141/374; 141/125; 177/122; 222/77

[58] Field of Search ..... 141/1-12, 141/128, 83, 95, 96, 94, 37-66, 250-284, 289-310, 374, 375, 87, 90, 93; 222/70, 77; 177/122

[56] References Cited

U.S. PATENT DOCUMENTS

| | | | |
|---|---|---|---|
| 2,812,919 | 11/1957 | Guerard et al. | 141/374 |
| 4,211,263 | 7/1980 | Kennedy et al. | 141/128 |
| 4,224,968 | 9/1980 | Bosser et al. | 141/374 |
| 4,337,802 | 7/1982 | Kennedy et al. | 141/128 |
| 4,494,583 | 1/1985 | Reeves et al. | 141/83 |
| 4,606,382 | 8/1986 | Biller et al. | 141/374 |
| 4,630,654 | 12/1986 | Kennedy et al. | 141/128 |

*Primary Examiner*—Houston S. Bell, Jr.
*Attorney, Agent, or Firm*—Arnold, White & Durkee

[57] ABSTRACT

Drum filling apparatus and method enabling liquid to be introduced into a container automatically. The apparatus includes a filling lance and a mechanism for gradually raising the filling lance to ensure that only a relatively small portion of the lance remains submerged in the liquid. The apparatus also includes a control mechanism for ensuring that the lance is properly positioned within the container as it is being withdrawn.

16 Claims, 3 Drawing Figures

RESERVOIR
14
POSITION SENSING DEVICE
62
SIGNAL GENERATOR
61
10
22
WEIGHT METER
60
70
2
26
24
42
16
18
28
60
40
12

70
71
26

DRUM FILLING APPARATUS AND METHOD

BACKGROUND OF THE INVENTION

This invention relates to a method and apparatus for dispensing predetermined amounts of liquid by weight into a container and, in particular, is directed toward an improved apparatus and method for dispensing liquid into a container of the type shown in commonly-assigned U.S. Pat. Nos. 4,211,263, 4,337,802 and 4,494,583, said patents are hereby incorporated by reference.

Depending upon the nature of the liquid, any of several filling techniques may be utilized to dispense a predetermined metered amount of liquid into the container. If the liquid is susceptible to foaming, it is typically the practice to insert a filling lance (the conduit through which the liquid passes into the container) into the container such that the lower discharge end of the lance is in close proximity to the bottom of the container.

In the method described in the patents incorporated by reference, the movement of the filling lance, sometimes referred to as a conduit, is normally initiated by the operator of the filling apparatus. A predetermined small amount of liquid is then slowly introduced into the container until the level of liquid in the container rises above the discharge end of the lance. Since the discharge of the lance is thereafter below the level of liquid in the container, most of the remaining weight of the liquid may be introduced into the container at a relatively faster fill rate until the fill rate is slowed down (to a dribble fill rate) just before the final weight of liquid has been dispensed.

During the fast fill operation, the lance is not raised within the container until a predetermined volume of fluid is added to the container. The lance is then raised to a position at which it finishes filling the container at a dribble fill rate. After the dribble fill is completed, the lance is fully withdrawn.

A significant problem commonly encountered by container filling apparatus such as that described in the incorporated patents was that the filling lance of the drum filling apparatus was immersed in the fill fluid during the filling operation. This is disadvantageous for certain materials such as quick setting polymeric films and the like. Even the wiper ring, disclosed in incorporated reference, U.S. Pat. No. 4,211,263, which is used to remove excess material, is often ineffective in keeping the filling lance clean when the drums are being filled with these types of film forming materials.

This invention provides an apparatus and a method for inhibiting the build-up of liquid materials on the filling lance of a drum filling apparatus.

One advantage of the present invention is that it reduces the quantity of liquid that may spill outside of the drum or container.

Another advantage of the present invention is that it reduces the quantity of noxious or toxic fumes that certain liquids may emit.

Still another advantage is that the operation of the drum filling apparatus will not be adversely affected by the buildup of fluids on the filling lance.

SUMMARY OF THE INVENTION

The above-noted and other drawbacks of the prior art are overcome, and the advantages stated above are achieved, by providing weight responsive apparatus which automatically raises the filling lance of a liquid filling apparatus until filling operations are completed. Although the filling lance is maintained subsurface throughout the filling operation, only a small portion of the filling lance is maintained subsurface at any point in time.

According to one aspect of the invention, the liquid filling apparatus is of a particularly simple and durable construction for increased dependability and efficiency in liquid filling operations and includes a movable conduit having an emission end for the passing of a liquid into a container.

A first signal generator or start mechanism is included for actuating the movement of the conduit from a raised position above the container to a lower position in which the emission end of the conduit is disposed just above the bottom of the container. A control valve which is operable to pass liquid at a dribble or fast-fill rate is interposed between a liquid source and the conduit.

A second signal generator is included, which generates a signal to actuate the dribble filling of the liquid, when the emission end of the conduit reaches a position just above the bottom of the container. The second signal generator also actuates a delay mechanism, which, in turn, triggers the fast-fill of liquid into the container, when the emission end of the conduit has been submerged in liquid, because of the dribble fill. According to this aspect of the invention, the signal that triggers the fast-fill may also actuate a lifting means or means for supplying a motive force, such as a motor or hydraulic cylinder, which gradually raises the conduit.

A weight responsive device, such as a scale, generates first and second control signals when the weight of liquid within the container reaches a first and second cut-off weight, respectively. The first control signal terminates the fast-filling of the liquid into the container and triggers a dribble fill rate of liquid. The second control signal actuates the termination of the dribble filling of the liquid and actuates movement of the conduit back to its raised position.

In a preferred embodiment, the liquid filling apparatus of this invention includes a base having a stanchion extending upwardly and a carriage mounted for vertical movement along the stanchion. A filler lance having an emission end is mounted for movement with the carriage. The control valve, with its actuator, is mounted on the carriage and communicates between a liquid source and the filling lance. The carriage may include a trip mechanism for actuating the second signal generator as it moves from its raised position to its lowered position.

An arm assembly extends outwardly from the stanchion over a container to be filled and is positioned such that the filler lance extends through the outer end of the arm in a guided relationship therewith as the lance is moved with the carriage into and out of the container. The arm assembly may include a wiper ring apparatus for wiping liquid which is collected on the outside surface of the emission end of the lance as it is withdrawn from a container, a fume disposal apparatus which entraps fumes generated by the liquid being introduced into a container and permits them to be drawn away from the area of the filling operation, and a drip collection apparatus which catches drips from the lance after the lance is withdrawn from a container. The assembly and design of these features is disclosed in detail in the commonly assigned patents incorporated herein by reference.

Accordingly, it is a general object of the present invention to provide a new and improved liquid filling apparatus of particularly simple and durable construction which is effective for accurate dispensation of predetermined weights of liquid and which enhances the safe and efficient handling of toxic or noxious liquids in a filling operation.

The above and other features and advantages of the present invention will become more apparent from a detailed description of a preferred embodiment when read in conjunction with the drawings.

DETAILED DESCRIPTION OF THE INVENTION

Figures 1, 2:
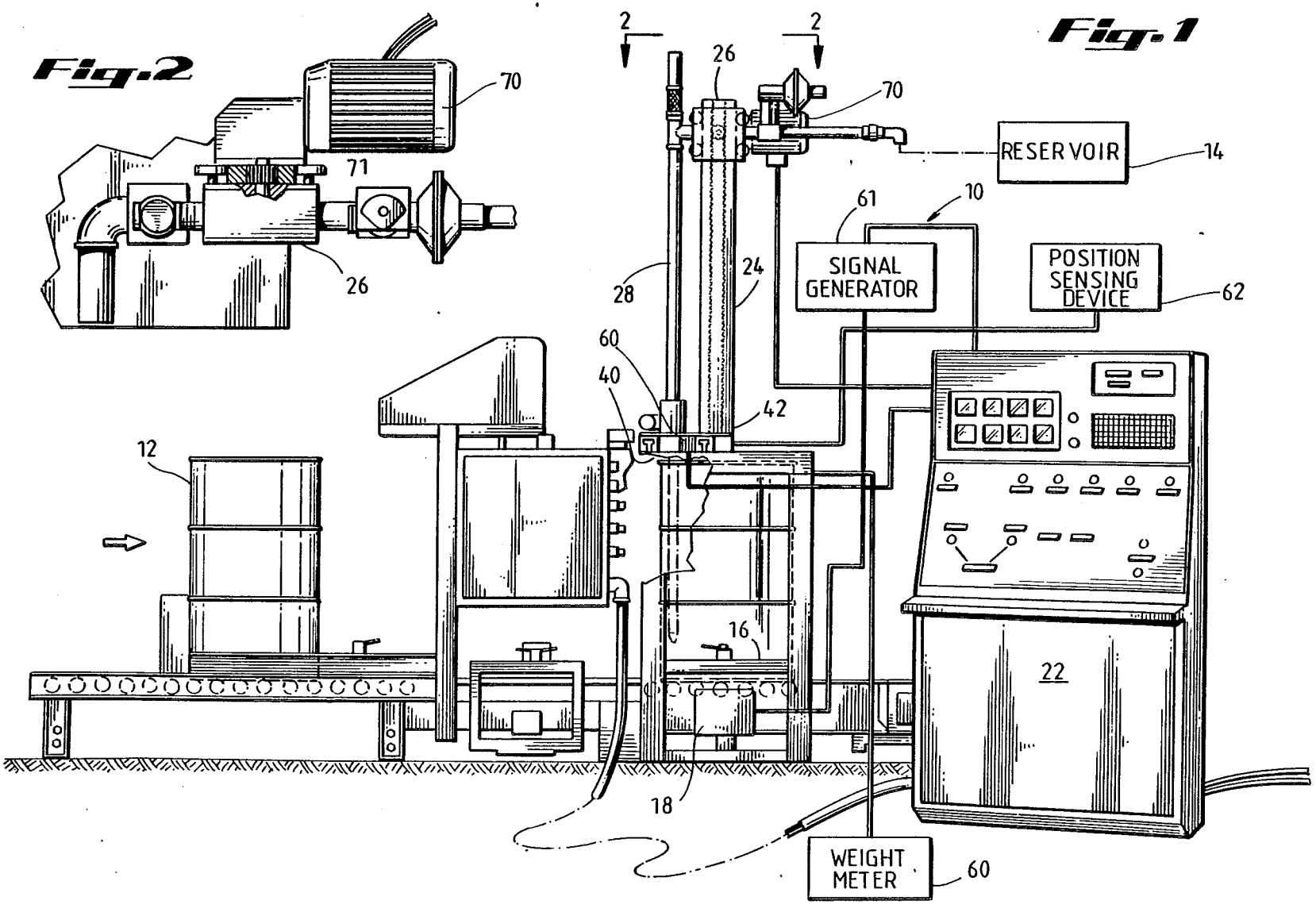
FIG. 1 is a front view of an embodiment of a liquid filling apparatus in accordance with this invention as disposed before a container base or conveying line and with the lance in the retracted position. The dashed lines represent the path that the lance follows as it gradually rises during filling operations.
FIG. 2 is a top view of the apparatus of claim 1, along line 2—2.

Throughout the following detailed description, similar reference numerals refer to similar elements in all Figures of the drawings.

Referring first to FIG. 1, there is shown a liquid filling apparatus generally indicated by reference numeral 10 in accordance with the present invention. A container 12, which is to be filled with a liquid product from a remote source or reservoir 14 (not shown), may be conveyed by manual or mechanical means from a receiving or storage area to the filling station of apparatus 10. Such a container typically is intended to receive a predetermined weight of liquid product from the filling apparatus. The container may then be moved to a discharge area.

More specifically, container 12 is moved into position before the filling apparatus on a base area 16 adjacent to the filling apparatus. The base 16 may, for example, be a portion of a conveyor system. Disposed beneath the base is a scale 18 or similar such weight-responsive device for determining when the container has been appropriately filled. This scale may consist of mechanical or electronic elements which are capable of generating control signals to a control panel 22 for the filling apparatus 10. Such control signals are generated as described in the incorporated references, when predetermined first and second cut-off weights are reached.

The filling apparatus is comprised of a stanchion 24 upon which a carriage 26 is movably mounted in a fashion facilitating vertical movement of a liquid conduit or filler lance 28 from a position above the container 12 to a position within the container. A control valve and an actuator as described in U.S. Pat. No. 4,211,263 (not shown), may be affixed to the carriage 26 and may be disposed between and in communication with the source of liquid 14, which may be situated behind the filling apparatus 10, and the filler lance 28, also as shown in U.S. Pat. No. 4,211,263. The flow of liquid into the container 12 may be introduced at a fast or dribble fill rate pursuant to appropriate actuation of the control valve.

Unless stated otherwise, operations of the filling apparatus 10 as herein described are pneumatically instigated, the pneumatic circuitry being housed in control panel 22. It will be appreciated, however, that alternative means for actuating the apparatus of this invention, such as electrical signals, are equally viable.

Control panel 22 includes a start switch (not shown) which is movable between "on" and "off" positions. Movement of the start switch generates a start signal, described hereinafter, which initiates the operation of the filling apparatus 10. The pneumatic connections and fittings between the filling apparatus 10 and the control panel 22 are not shown.

When liquids which tend to foam or which generate fumes or noxious odors are being introduced into a container, a subsurface fill technique is utilized. The conduit or lance 28 must be introduced into the container until its emission end 40 is disposed just above the bottom of the container. In accordance with the invention, the lance 28 is mounted for vertical reciprocation by the translation of carriage 26 along stanchion 24.

The filling apparatus 10 may include an arm assembly which incorporates a lance wiper ring apparatus, a drip collection apparatus and a fume disposal apparatus, all of which are described in the commonly assigned patents which have been incorporated herein by reference. As indicated previously, it is often necessary to deal with liquid substances which may be highly toxic or noxious, and special care must be taken to avoid any contamination or leakage occurring during or as a result of the filling operation. These features may be present in this invention substantially as shown and described in previously incorporated, commonly-assigned U.S. Pat. Nos. 4,211,263 and 4,337,802.

Figure 3:
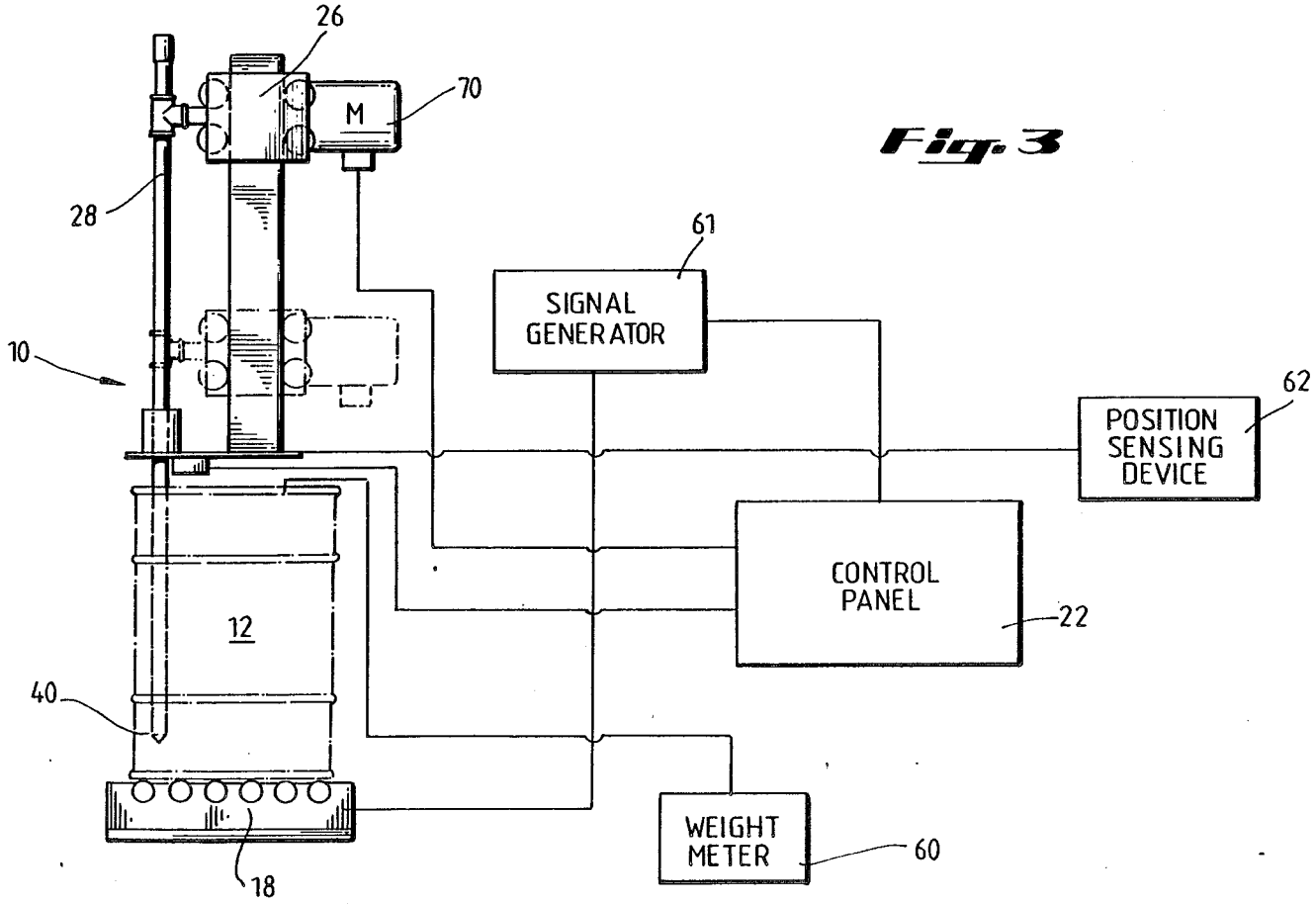
FIG. 3 is a schematic view of the apparatus used to enable the lance to incrementally rise during filling operations in response to a weight sensitive sequencing routine.

Filling apparatus 10 also includes motor 70, weight meter 60, signal generator 61, and position sensing device 62. The arrangement of these parts to the remainder of filling apparatus 10 is shown schematically in FIG. 3.

Weight meter 60 records the weight of container 12 together with the amount of liquid added to container 12. Weight meter 60 records this weight as lance 28 gradually rises under the control of motor 70. When the weight of container 12, together with the added liquid, reaches a predetermined value, signal generator 61 generates a signal to control panel 22 which, in turn, generates a signal to motor 70. That signal causes motor 70 to substantially reduce the speed at which it had been raising lance 28. At the same time, that signal triggers a dribble fill rate until filling operations are completed. This substantial reduction in the withdrawal speed of lance 28, in response to the signal from signal generator 61, ensures that the distal portion of the emission end of lance 28 will remain submerged in the liquid during the dribble fill stage.

Position sensing device 62 is, in a preferred embodiment, a potentiometer which emits an output signal that indicates the position of lance 28. For instance, if the potentiometer reads zero volts it would indicate that lance 28 is near the bottom of container 12. A potentiometer reading of five volts would indicate a middle position of lance 28, whereas a potentiometer reading of ten volts would indicate a top positioning.

The method of the present invention of filling a container with a liquid will be explained hereinafter as would be utilized for a product being introduced into a container, which product is either subject to foaming or to giving off noxious fumes or is film forming in nature.

The container 12, which is to be filled with a predetermined weight of liquid, is first appropriately positioned beneath the emission end 40 of the lance 28. The start switch on control panel 22 is moved, producing a first control signal that initiates a sequence, which results in the lowering of the carriage 26 and the lance 28 into the container 12 to a position where the emission end 40 of the lance is just above the bottom of the container. FIG. 2 shows that motor 70 is joined to carriage 26 with rack and pinion 71, enabling motor 70 to drop and rise with carriage 26 and lance 28.

After being lowered, a second signal generator, such as a tripping mechanism, causes the dribble fill of the liquid into the container to begin and to continue for a preset interval of time (called prefill), to allow the level of liquid introduced into the container to rise above the emission end 40 of the lance 28. This time may be set by the operator. Typically the distal end of the emission end 40 of lance 28 is covered and remains covered by the liquid. Distal end is intended to refer to the 1 to 8 inches of lance 28 nearest the bottom of the container.

Once the preset interval has passed, a signal acts to open fully the control valve to permit fast fill of liquid into the container. This signal also actuates motor 70, causing motor 70 to gradually lift lance 28. The rate of lift is determined by the density of the fluid and by the desired rate of fill.

The fast fill condition and gradual rise of lance 28 continues until such time as the weight of the liquid in the container 12 reaches the first cut-off weight, at which time the scale 18 generates its first control signal. The first control signal may be generated when about 90% of the desired liquid weight has been achieved. This first control signal causes the fill rate to be reduced from a fast fill to a second dribble fill and causes motor 70 to reduce the speed at which it was raising lance 28, to compensate for the decreased fill rate, i.e., the second dribble fill rate, that this first control signal generates. Preferably, lance 28 is about two inches below the top of container 12 when this second dribble fill begins. Once the predetermined amount of liquid has been introduced into container 12, a second control signal, activated by a second cut-off weight, causes lance 28 to be fully withdrawn.

The lance withdrawal rate depends upon the rate at which fluid is being introduced into container 12. The rate of fluid fill is in turn dependent on the size and power of the filling apparatus and the foaming characteristics of the liquid being filled. Consequently, motor 70 must be calibrated to enable lance 28 to be withdrawn at a different speed depending upon the rate at which fluid is emitted from lance 28 and depending upon the dimensions of container 12. Preferably, motor 70 will be calibrated so that lance 28 can be maintained at a level of approximately two inches below the surface of the liquid. Maintaining lance 28 at this level relative to the liquid surface precludes exposure of the remainder of lance 28 to the liquid material added to container 12.

Weight meter 60 and position sensing device 62 work together to ensure that the emission end of lance 28 remains below the surface of the liquid, and to ensure that an insubstantial amount of lance 28 is immersed in the fluid at any time during filling operations. Position sensing device 62 sends a signal to control panel 22 indicating the position of lance 28 within container 12. Weight meter 60, through signal generator 61, sends a signal to control panel 22 providing the weight of container 12 along with the liquid in container 12.

A comparator in control panel 22 compares the weight of container 12 with the position of lance 28. The position of lance 28 needed to keep the proper amount of lance 28 immersed in the fluid at any time during filling operations for a given weight of a particular fluid may be easily determined from the fluid's density and the container's diameter. A comparison between the weight of container 12, indicating the amount of fluid in container 12, with the potentiometer reading, indicating the position of lance 28 within container 12, indicates whether lance 28 is submerged too far into the liquid or not submerged far enough. If this comparison shows that the liquid is not immersed far enough, i.e., motor 70 is causing lance 28 to be withdrawn at too fast a rate, then control panel 22 generates a signal to motor 70. This signal causes motor 70 to decrease the speed at which it causes lance 28 to be withdrawn, until the rate of withdrawal of lance 28, together with the rate at which fluid is added to the container, ensure that the proper amount of lance 28 is immersed in the fluid. If the comparison of the weight in container 12 to the position of lance 28 shows that too much of lance 28 is immersed in the liquid, control panel 22 generates a signal to motor 70 causing motor 70 to increase the withdrawal rate until the optimum amount of lance 28 is immersed in the liquid.

It is apparent that a hydraulic cylinder may replace motor 70 as the lifting means for supplying the force welded to gradually raise 1 and 28.

Liquid filling apparatus 10 may include alignment means for aligning the bung hole of container 12 with lance 28. Examples of such alignment means are shown in U.S. Pat. No. 4,494,583, hereby incorporated by reference.

Having described the preferred embodiment of the invention, those skilled in the art may effect numerous modifications thereto in view of the foregoing description. It is, however, understood that such modifications lie within the contemplation and scope of this invention as defined in the appended claims.

What is claimed is:

1. Liquid filling apparatus for subsurface filling of containers comprising:

(a) a conduit for introducing liquid into a container, said conduit being incrementally movable between a raised and lowered position;

(b) a first signal generator for generating a signal to initiate movement of said conduit from its raised position to its lowered position;

(c) a second signal generator operating in cooperation with a weight responsive device for generating a control signal when a predetermined amount of said liquid is added to said container, said control signal being operable to actuate lifting means, said lifting means actuating the upward movement of said conduit at a rate such that only the distal end of the emission end of the conduit is submerged in said fluid during the fill cycle; and (d) said weight responsive device generating a control signal when the weight of said liquid in said container equals a cut-off weight, said control signal being operable to initiate withdrawal of said conduit toward its raised position.

2. The liquid filling apparatus of claim 1 wherein said lifting means is a motor.

3. The liquid filling apparatus of claim 1 wherein said lifting means are hydraulically actuated.

4. The liquid filling apparatus of claim 1 further including a sensing mechanism for aligning the bung of said container with said conduit.

5. The liquid filling apparatus of claim 1 further comprising a valve to control the rate of flow of liquid through said conduit to said container.

6. The liquid filling apparatus of claim 4 wherein said first signal generator, for generating a signal to initiate movement of said conduit from its raised position to its lowered position, is actuated by said sensing mechanism.

7. The liquid filling apparatus of claim 1 wherein said second signal generator is actuable by movement of the conduit towards its lowered position and generates a signal to actuate the valve to commence flow of liquid at a slow fill rate into such a container prior to actuating said lifting means.

8. The liquid filling apparatus of claim 5 further comprising a delay mechanism actuable by the signal from said second signal generator to trigger a fast fill rate dispensation of liquid after a predetermined interval, as well as to actuate said lifting means.

9. The liquid filling apparatus of claim 1 further comprising a wiper device for urging liquid adhering to the outside of the emission end of said conduit toward such a container during withdrawal of said conduit.

10. The liquid filling apparatus of claim 1 wherein said weight responsive device generates a control signal, after said conduit has been raised a predetermined distance within said container, for decreasing the rate of upward movement of said conduit and for actuating a slow fill rate, prior to generating a control signal to initiate withdrawal of said conduit.

11. A method for filling a container with a predetermined weight of liquid, which liquid is subject to foaming or the production of toxic or noxious fumes, comprising the steps of:

actuating the movement of a conduit for the introduction of the liquid into the container to a predetermined position just above the bottom of the container;

introducing liquid into the container at a dribble fill rate for a predetermined time until the distal end of said conduit is submerged in the liquid, the liquid introduction beginning in response to a signal generated when the conduit reaches its position just above the bottom of the container;

increasing the liquid introduction to a fast fill rate while simultaneously gradually raising said conduit, in response to a signal generated after the end of said conduit is submerged;

decreasing the rate of withdrawal of the conduit, when said conduit reaches a predetermined distance from the surface of said container, which maintains the conduit end submerged in the liquid, while returning the rate of liquid introduction to a dribble fill rate, in response to a signal generated when a first predetermined cut-off weight of liquid within the container is reached;

initiating full shut-off of liquid flow through the conduit and full withdrawal of the conduit from the container in response to a signal generated when a second predetermined cut-off weight of liquid in the container is achieved.

12. The method of claim 11 further comprising the step of:

moving a collection device beneath the conduit in response to a signal generated when the conduit is fully withdrawn to collect any excess liquid adhering to the conduit as it drips therefrom.

13. The method of claim 11 further comprising the step of:

wiping the external surface of the conduit during the withdrawal of the conduit in a manner which urges the liquid adhering to the emission end of the conduit into the container.

14. The method of claim 11 further comprising the step of:

sensing the position of said conduit as it is gradually raised within said container with a position sensor.

15. The method of claim 14 wherein said position sensor is a potentiometer.

16. The method of claim 11 further comprising the steps of:

comparing the weight of the container to the position of the conduit and adjusting the rate of withdrawal of said conduit in response to said comparison.

* * * * *